US005120260A

United States Patent [19]

Jackson

[11] Patent Number: 5,120,260

[45] Date of Patent: Jun. 9, 1992

[54] CONNECTOR FOR SEMI-RIGID COAXIAL CABLE

[75] Inventor: Samuel H. Jackson, Ardsley, N.Y.

[73] Assignee: Kings Electronics Co., Inc., Tuckahoe, N.Y.

[21] Appl. No.: 248,333

[22] Filed: Sep. 20, 1988

Related U.S. Application Data

[63] Continuation of Ser. No. 822,679, Jan. 23, 1986, abandoned, which is a continuation of Ser. No. 525,317, Aug. 22, 1983, abandoned.

[51] Int. Cl.[5] ..... H01R 17/04

[52] U.S. Cl. ..... 439/585; 439/578

[58] Field of Search ..... 439/607-610, 439/578-585, 98, 99

[56] References Cited

U.S. PATENT DOCUMENTS

| | | | |
|---|---|---|---|
| 3,336,566 | 8/1967 | Barker | 339/177 R |
| 3,792,419 | 2/1974 | Spinner | 339/177 R |
| 3,923,367 | 12/1975 | Carter | 339/177 R |
| 4,178,054 | 12/1979 | Laudig | 339/177 R |
| 4,400,050 | 8/1983 | Hayward | 338/177 R |
| 4,445,745 | 5/1984 | Cartesse | 339/177 R |

FOREIGN PATENT DOCUMENTS

| | | | |
|---|---|---|---|
| 138116 | 4/1930 | Fed. Rep. of Germany | 339/258 A |
| 1039665 | 9/1958 | Fed. Rep. of Germany | 339/258 A |

*Primary Examiner*—David L. Pirlot
*Attorney, Agent, or Firm*—Jordan B. Bierman

[57] ABSTRACT

An improved electrical connector for receiving a semi-rigid coaxial cable includes, at the proximal end of the connector body, an annular sleeve inwardly tapered to a diameter smaller than the minimum manufactured diameter of the cable, and a plurality of relatively narrow slots axially defined in the sleeve so that, as the cable is inserted into the connector body toward its proximal end, it enters and contacts the sleeve which diametrically expands at the slots to accommodate and firmly grasp the cable at the mating interface end of the connector.

8 Claims, 1 Drawing Sheet

FIG. 1
PRIOR ART
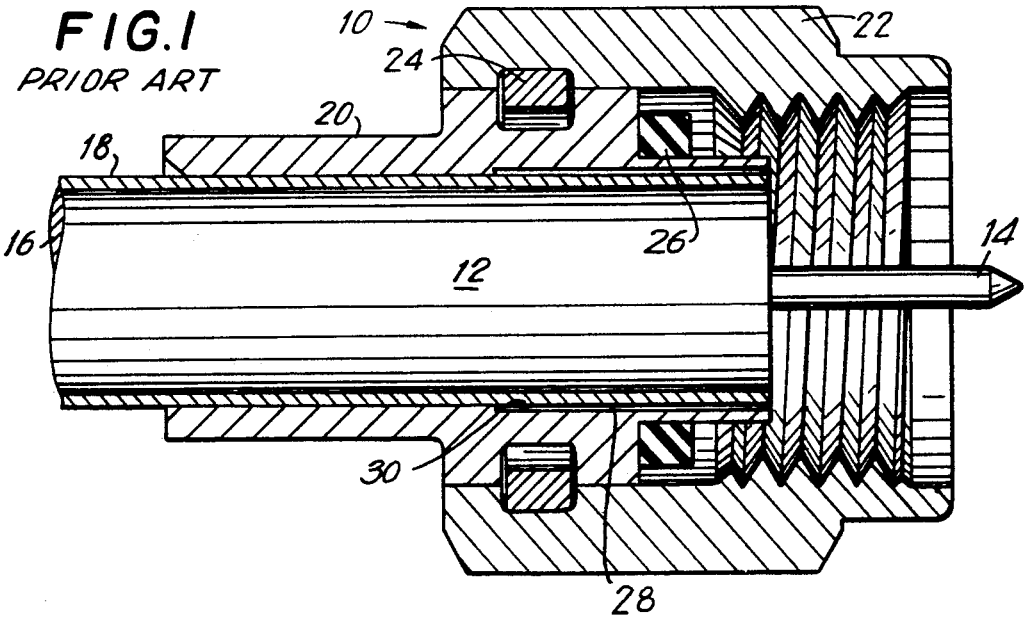
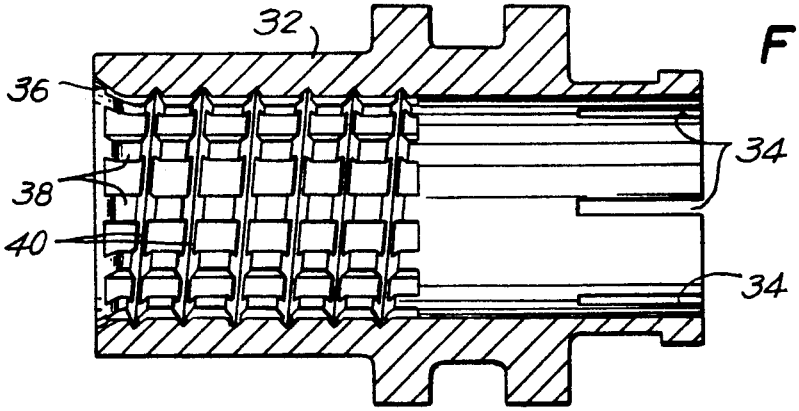
FIG. 2
FIG. 3
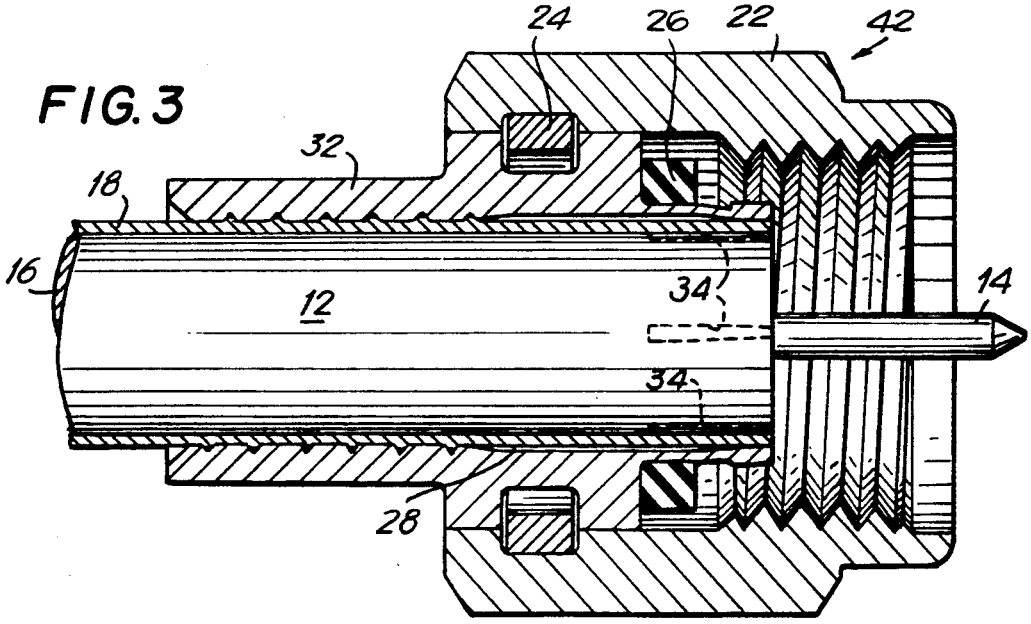

CONNECTOR FOR SEMI-RIGID COAXIAL CABLE

This application is a continuation of application Ser. No. 822,679, filed Jan. 23, 1986 now abandoned, which is continuation, of application Ser. No. 525,317, filed Aug. 22, 1983 now abandoned.

BACKGROUND OF THE INVENTION

The present invention relates to an improved electrical connector for semirigid coaxial cable and, more particularly, to a connector constructed to eliminate an RF choking phenomenon associated with connectors crimped to semirigid coaxial cable.

A typical semirigid coaxial cable includes an inner electrical conductor, a surrounding dielectric and a semirigid outer conductor peripherally enveloping the dielectric. Although such cables are generally provided in standard diametric sizes, commonly practiced manufacturing techniques result in diametric variations along the cable length such that, for purposes of standardization, this cable parameter is often specified in terms of nominal size—the magnitude of acceptable variations from nominal size being known.

Terminating electrical connectors for semirigid coaxial cable must be correspondingly provided with inside diameters dimensioned to accomodate the manufacturing variations permissible for cable of a given nominal size. The combination of required connector and cable tolerances yields a small but variable annular gap between the outer diameter of the cable and the interior diameter of the connector. In utilizing known connectors that are soldered to the cable, the solder flows into and fills the radial gap to create an electrically and mechanically stable structure. However, in solderless connectors—i.e. those that are crimped or similarly mechanically secured to the semirigid outer conductor of the cable—the annular gap is not filled and its presence, particularly at the interface with a mating connector or jack, produces a so-called choke effect. In essence, the gap acts as a microwave cavity which resonates at frequencies dependent upon its dimensions; the result is a sharp increase in the voltage standing wave ratio (VSWR) at some particular frequency.

Referring, by way of example, to FIG. 1, a prior art crimp-type connector generally designated 10 is illustrated in secured relation about a semirigid coaxial cable 12. Cable 12 comprises an inner conductor 14 surrounded by a dielectric 16 and, in turn, by a semirigid outer conductor 18 of a minimum manufactured diameter. The elongated connector body 20 is crimped about cable 12 at the rear or distal end of the body. A threaded coupling nut 22 disposed for free axial rotation about the proximal end of body 20 is coupled to the body by a C-ring 24 or the like. An annular gasket 26 provides a cushioned seal when connector 10 is coupled or secured to a mating connector (not shown) in conventional fashion to electrically connect cable 12 to another cable or to a terminal device or the like.

Clearly visible in FIG. 1 is the aforementioned annular gap 28 lying between the outer periphery of semirigid outer cable conductor 18 and the interior peripheral wall 30 at the proximal end of connector body 20. Clearly, even with careful machining of the proximal bore in body 20 the dimensions of gap 28 will vary from cable to cable in accordance with corresponding variations in the cable outer diameter. In addition, the dimensions of gap 28 are altered when the cable is stressed or flexed in the vicinity of connector 10, causing the VSWR peaks to be evanescent in nature. The points of contact between connector body surface 30 and the periphery of semirigid outer cable conductor 18 shift back and forth with stress on or flexing of the cable causing transitory impedance disturbances and reflective losses at the interface between mated connectors.

It is accordingly the desideratum of the present invention to provide an improved connector that, when conventionally crimped or otherwise attached about semirigid coaxial cable, provides a secure mechanical connection to the cable in the area of the mated connection interface.

It is a further object of the invention to provide an improved connector for semirigid coaxial cable that prevents the formation of a gap between the outer periphery of the cable and the interior surface of the connector body at the proximal end or mated connection interface of the connector.

It is another object of the invention to provide an improved connector for semirigid coaxial cable that eliminates the so-called choke effect produced when conventional crimp-type connectors are attached to semirigid cable.

It is a still further object of the invention to provide an improved connector for semirigid coaxial cable that satisfies the foregoing objects while remaining electrically and mechanically compatible with existing conventional mating connectors.

Other objects and features of the present invention will become apparent from the following detailed description considered in conjunction with the accompanying drawings. It is to be understood, however, that the drawings are designed solely for purposes of illustration and not as a definition of the limits of the invention for which reference should be made to the appended claims

BRIEF DESCRIPTION OF THE DRAWING

In the drawing, wherein similar reference characters denote similar elements throughout the several views:

FIG. 1 is a side view, in section, of a known prior art connector crimped about a semirigid coaxial cable;

FIG. 2 is a side view, in section, of an improved connector body in accordance with the invention as initially manufactured; and FIG. 3 is a side view, in section, of an improved connector in accordance with the present invention and crimped about a semirigid coaxial cable.

DETAILED DESCRIPTION OF THE PREFERRED EMBODIMENT

Referring now to FIG. 2, there is shown an improved connector body 32 constructed in accordance with the present invention. More particularly, in the manufacture of body 32 a plurality of relatively narrow slots 34 are axially defined in the sleeve forming the proximal end of the body. Slots 34 are circumferentially spaced about the sleeve and adjacent slots may be equally spaced one from the other. FIG. 2 illustrates the initially manufactured appearance of connector body 32 wherein slots 34 are substantially rectangularly configured. Prior to engagement of body 32 with threaded coupling nut 32, however—and correspondingly before a coaxial cable 12 is inserted into the inventive connector—the proximal end of body 32 is crimped or similarly radially compressed to diametrically constrict its mating interface end to a diameter smaller than the minimum manufactured diameter of the semirigid outer conductor 18 of cable 12. Slots 34, as a consequence of this operation, thereby generally take on the frustroconical shape seen in the centrally-disposed slot of FIG. 3.

It should in any event be understood that the tapering by radial compression or otherwise, of the proximal end of body 32 is intended to be performed as part of the connector manufacturing process and not by its end user. Although such tapering could be done by the end user, it is contemplated that this step be completed prior to shipment to or receipt by the end user of the inventive connector.

The inventive connector body 32 in FIG. 2 is additionally illustrated at its distal end with a crimpable shell 36 which comprises a series of axial or longitudinal flutes 38 and substantially transverse cross threads 40. Flutes 38 and cross threads 40 are formed as projections which extend radially inward from shell 36 to immediately surround a semirigid outer cable conductor 18 inserted into body 32 so that, when deformable shell 36 is crimped the projections bite into the outer surface of semirigid outer conductor 18 (see FIG. 3) to secure the same to the body distal end against rotational and longitudinal movement, In any event, the particular crimpable or alternative attaching structures provided at the body distal end and their precise manner of operative securement to the semirigid outer conductor of the cable are purely matters of design choice and no limitation on the present invention is intended by the illustrated construction.

In use, semirigid coaxial cable 12 is inserted into the inventive connector 42 through the distal end of body 32 until the cable end—as defined by the end of outer conductor 18—is substantially aligned with the proximal end face or mating connection interface of connector body 32 (FIG. 3). As the cable is inserted into body 32 toward its proximal end the semirigid outer conductor 18 enters and contacts the proximal end sleeve which, having been previously formed to less than the minimum manufactured diameter of the cable outer conductor, diametrically expands at slots 34 to accomodate and firmly grasp the cable at the connector body proximal end. In this manner, the connector body makes firm and secure electrical and mechanical contact with semirigid outer cable conductor 18 along the entire periphery of the cable along a plane perpendicular to the cable axis at the connector body mating interface or proximal end. The connector may then be crimped to semirigid outer cable conductor 18 at the distal end of body 32 in conventional fashion.

The disclosed construction for an improved connector body has been demonstrated to yield notably superior performance with respect to prior art connectors over a wide frequency range. With the elimination of possible formation of an annular gap at the connector mating interface end has come a corresponding elimination of the so-called choke effect. Moreover, the mechanical and electrical attachment of improved connector 42 to a semirigid coaxial cable 12 is unaffected by flexing or stressing of the cable, thereby eliminating a heretofore common source of signal distortion or perturbations.

While there has been shown and described and pointed out fundamental novel features of the invention as applied to a preferred embodiment thereof, it should be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. An electrical connector for receiving a coaxial cable having an inner conductor surrounded by a dielectric and in turn by a semirigid outer conductor of a minimum manufactured diameter, said dielectric and said outer conductor terminating in a face, said connector including an axially elongated body having attaching means proximate its distal end for achieving positive mechanical securement of the attaching means to the semirigid outer conductor of a cable inserted into the body at its distal end and extending to a position proximate its proximal end, contact means at the proximal end of the body at said face for assuring firm electrical and mechanical contact with the cable outer conductor, said contact means comprising:

an annular sleeve inwardly tapered in the direction of the body proximal end to a diameter smaller than the minimum manufactured diameter of the cable outer conductor; and a plurality of relatively narrow slots axially defined in said sleeve so that as the cable is inserted int the connector body toward its proximal end the semirigid outer conductor enters and contacts said sleeve which diametrically expands at said slots to accommodate and firmly grasp the cable at the connector body proximal end, whereby the choke effect of said connector is reduced.

2. A connector in accordance with claim 1, said attaching means comprising crimpable means.

3. A connector in accordance with claim 1, each of said slots being inwardly tapered in the direction of said body proximal end.

4. A connector in accordance with claim 1, each of plural slots being circumferentially spaced about said sleeve.

5. A connector in accordance with claim 1, said attaching means comprising a radially deformable annular shell to surround the semirigid outer conductor of the cable at the connector body distal end, and means forming projections extending radially inward within said shell to immediately surround the outer conductor so that when said deformable shell is crimped said projections bite into the outer surface of the semirigid outer conductor to secure the same to the attaching means against rotational and longitudinal movement.

6. A connector in accordance with claim 5, said projection forming means being aligned axially along the connector body.

7. A connector in accordance with claim 5, said projection forming means extending substantially transverse to the elongation of the connector body.

8. A connector in accordance with claim 5, said projection forming means extending both axially along and substantially transverse to the elongation of the connector body.

* * * * *